United States Patent [19]

Barito et al.

[11] Patent Number: 4,992,032

[45] Date of Patent: Feb. 12, 1991

[54] SCROLL COMPRESSOR WITH DUAL POCKET AXIAL COMPLIANCE

[75] Inventors: Thomas R. Barito, East Syracuse; Howard H. Fraser, Jr., Lafayette, both of N.Y.

[73] Assignee: Carrier Corporation, Syracuse, N.Y.

[21] Appl. No.: 418,079

[22] Filed: Oct. 6, 1989

[51] Int. Cl.[5] ..... F04C 18/04; F04C 27/00

[52] U.S. Cl. ..... 418/55.4; 418/55.5; 418/57

[58] Field of Search ..... 418/55.4, 57, 55.5

[56] References Cited

U.S. PATENT DOCUMENTS

| | | | |
|---|---|---|---|
| 3,600,114 | 8/1971 | Dvorak et al. | 418/55 D |
| 3,884,599 | 5/1975 | Young et al. | 418/55 D |
| 3,924,977 | 12/1975 | McCullough | 418/55 D |
| 3,994,633 | 11/1976 | Shaffer | 418/5 |
| 4,496,296 | 1/1985 | Arai et al. | 418/55 D |
| 4,645,437 | 2/1987 | Sakashita et al. | 418/55 D |
| 4,743,181 | 5/1988 | Murayama et al. | 418/55 D |

FOREIGN PATENT DOCUMENTS

| | | | |
|---|---|---|---|
| 63-106388 | 5/1988 | Japan | 418/57 |

*Primary Examiner*—John J. Vrablik

*Attorney, Agent, or Firm*—David J. Zobkiw

[57] ABSTRACT

Two annular pressure pockets are used to push the orbiting scroll against the fixed scroll to minimize leakage. One pocket is at intermediate pressure and the other is at discharge pressure. The pockets are defined by the orbiting scroll and an axial ring. In the preferred embodiment inner and outer seals are carried by the axial ring and an intermediate seal is carried by the orbiting scroll whereby the pressure pockets are of an eccentric configuration.

6 Claims, 3 Drawing Sheets

SCROLL COMPRESSOR WITH DUAL POCKET AXIAL COMPLIANCE

BACKGROUND OF THE INVENTION

In a scroll compressor the trapped volumes are in the shape of lunettes and are defined between the wraps or elements of the fixed and orbiting scrolls and their end plates. The lunettes extend for approximately 360° with the ends of the lunettes defining points of tangency or contact between the wraps of the fixed and orbiting scrolls. These points of tangency or contact are transient in that they are continuously moving towards the center of the wraps as the trapped volumes continue to reduce in size until they are exposed to the outlet port. As the trapped volumes are reduced in volume the ever increasing pressure acts on the wrap and end plate of the orbiting scroll tending to axially and radially move the orbiting scroll with respect to the fixed scroll.

Radial movement of the orbiting scroll away from the fixed scroll is controlled through radial compliance. Eccentric bushings, swing link connections and slider blocks have all been disclosed for achieving radial compliance. Each approach ultimately relies upon the centrifugal force produced through the rotation of the crankshaft to keep the wraps in sealing contact.

Axial movement of the orbiting scroll away from the fixed scroll produces a thrust force. The weight of the orbiting scroll, crankshaft and rotor may act with, oppose or have no significant impact upon the thrust force depending upon whether the compressor is vertical or horizontal and, if vertical, whether the motor is above or below the orbiting scroll. Also, the highest pressures correspond to the smallest volumes so that the greatest thrust loadings are produced in the central portion of the orbiting scroll but over a limited area. The thrust forces push the orbiting scroll against the crankcase with a large potential frictional loading and resultant wear. A number of approaches have been used to counter the thrust forces such as thrust bearings and a fluid pressure back bias on the orbiting scroll. Discharge pressure and intermediate pressure from the trapped volumes as well as an external pressure source have been used to provide the back bias. Specifically, U.S. Pat. Nos. 3,600,114, 3,924,977 and 3,994,633 utilize a single fluid pressure chamber to provide a scroll biasing force. This approach provides a biasing force on the orbiting scroll at the expense of very large net thrust forces at some operating conditions. As noted, above, the high pressure is concentrated at the center of the orbiting scroll but over a relatively small area. If the area of back bias is similarly located, there is a potential for tipping since some thrust force will be located radially outward of the back bias. Also, with the large area available on the back of the orbiting scroll, it is possible to provide a back bias well in excess of the thrust forces.

SUMMARY OF THE INVENTION

An axial ring is provided which coacts with the back of the orbiting scroll to form two annular fluid pressure chambers for providing a back bias to the orbiting scroll. Preferably the inner annular chamber is at discharge pressure and the outer annular chamber is at an intermediate pressure. This arrangement locates the discharge chamber and the greatest back bias opposite the greatest thrust force. A wider operating envelope is possible because the dual pocket configuration allows for a smaller range of thrust forces than a single pocket configuration and thereby provides a more stable arrangement. The axial ring is fixed to or integral with the crankcase so that the orbiting scroll moves with respect to the ring. In one embodiment three annular seals are carried by the ring to define the two annular fluid pressure chambers. In a second embodiment the inner and outer seals are carried by the ring while the middle seal is carried by the orbiting scroll. As a result, the middle seal moves with respect to the inner and outer seals so that two moving eccentric annular fluid pressure chambers are formed. The eccentricity of the discharge pressure chamber provides an eccentric biasing force on the back face of the orbiting scroll. The eccentric biasing force counteracts the eccentric axial gas force formed in the scroll wraps. The end result is that the back biasing force does not need to be excessive in order to overcome the moment created by the axial gas force. Thus, the present invention provides a smaller range of net thrust forces throughout the operating envelope and is therefore at least as efficient as known designs while avoiding seizure at the scroll tips and excessive wear due to excessive thrust forces.

It is an object of this invention to provide a wider and more stable operating envelope.

It is another object of this invention to improve axial compliance over the entire operating envelope.

It is a further object of this invention to minimize thrust losses on the back face of the orbiting scroll.

It is an additional object of this invention to provide a small range of scroll axial thrust forces throughout the operating envelope. These objects, and others as will become apparent hereinafter, are accomplished by the present invention.

Basically, two sealed pressure chambers are located on the back of the orbiting scroll to overcome the gas compression forces within the scroll wraps and to bias the orbiting scroll towards the fixed scroll. The two chambers are formed by three circular seals of different diameters mounted in the crankcase and/or orbiting scroll. One sealed chamber is pressurized by intermediate pressure gas and the other by discharge gas. In a preferred embodiment the inner and outer seals are carried by the fixed axial ring partially defining the chambers while the middle seal is carried by the orbiting scroll. As a result, the configurations of the chambers change with movement of the orbiting scroll to reflect the current loading. In another embodiment the three seals are concentric and carried by the fixed axial ring.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
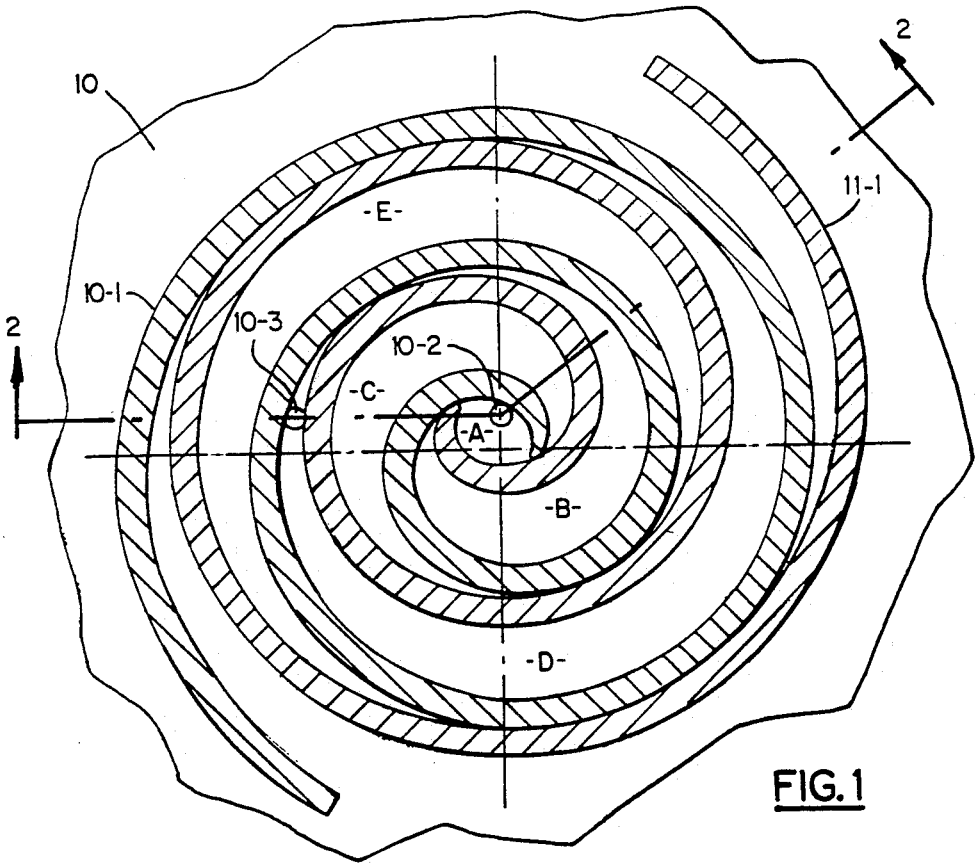
FIG. 1 is a sectional view of the fixed and orbiting scrolls of a scroll compressor taken along line 1—1 of FIG. 2.
Figure 2:
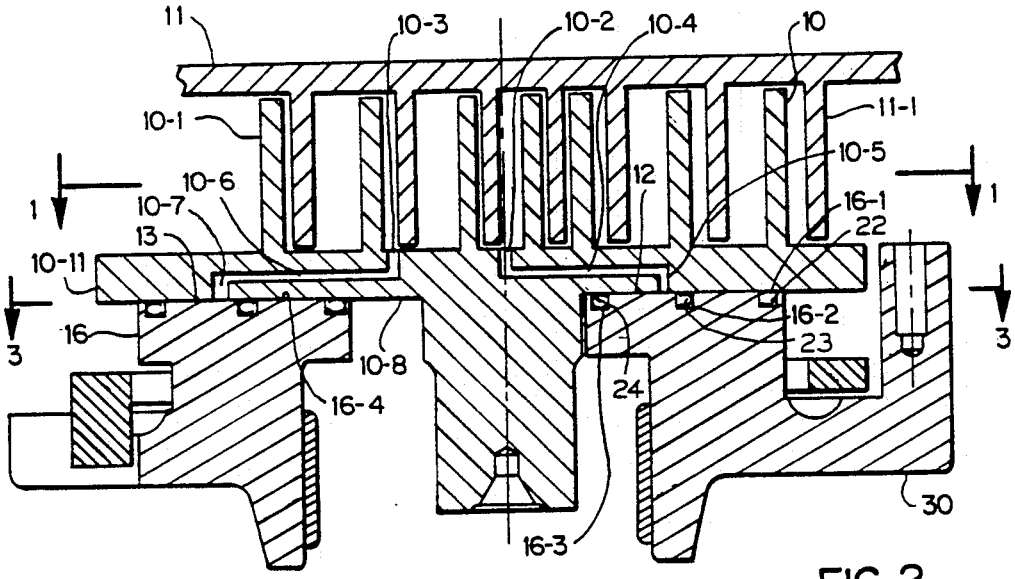
FIG. 2 is a sectional view taken along line 2—2 of FIG. 1.
Figure 3:
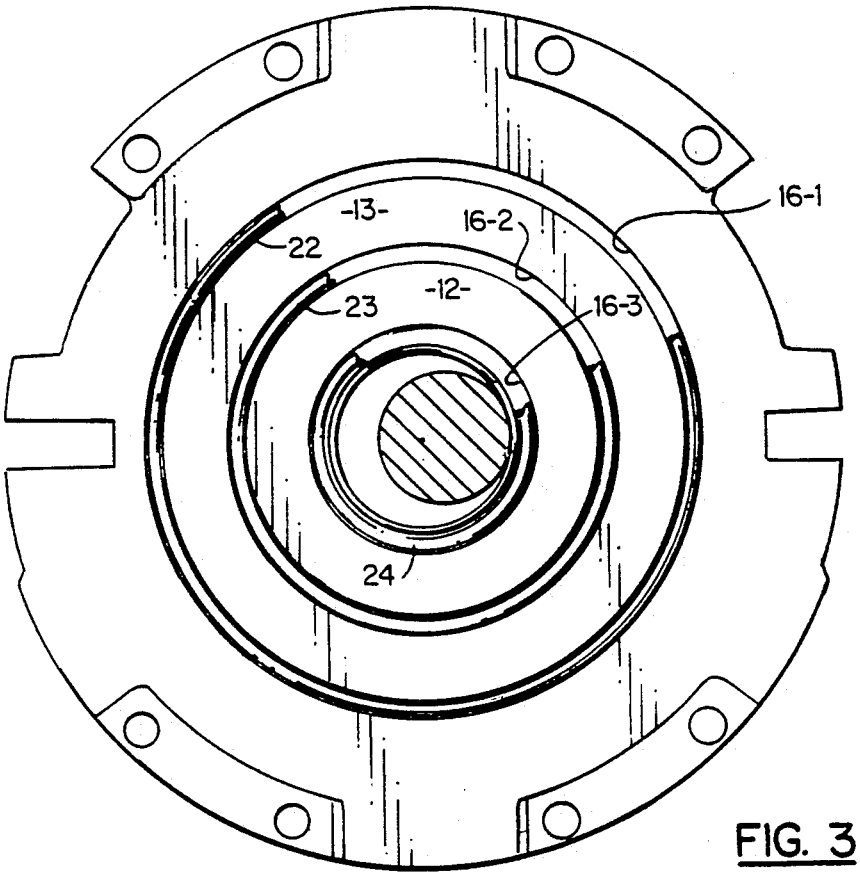
FIG. 3 is a sectional view taken along line 3—3 of FIG. 2.
Figure 4:
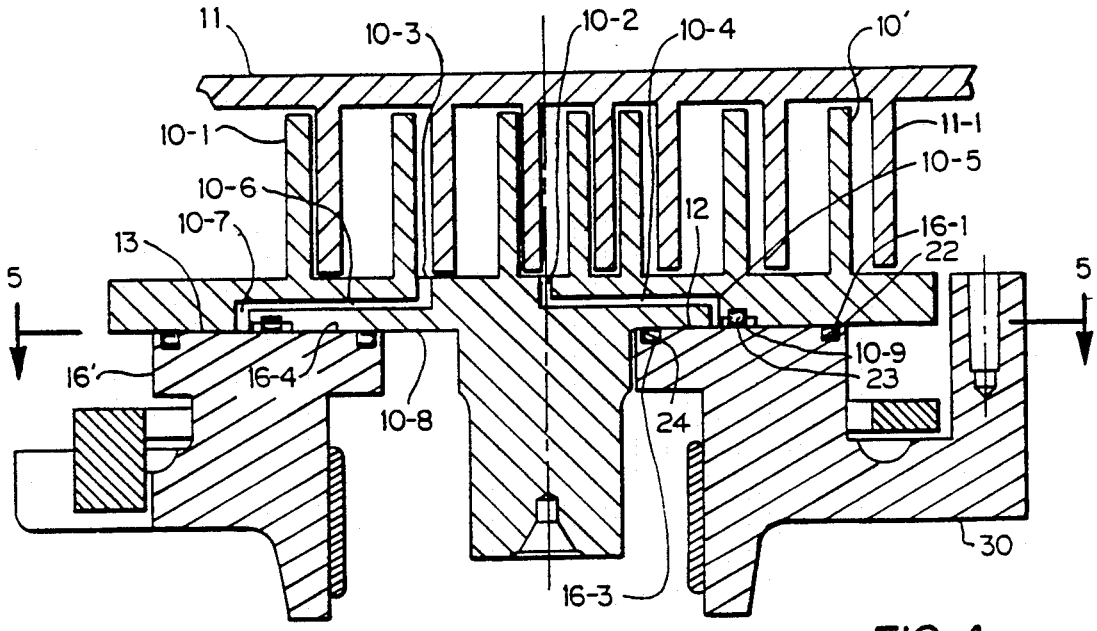
FIG. 4 is a sectional view of a modified embodiment and corresponds to FIG. 2.
Figure 5:
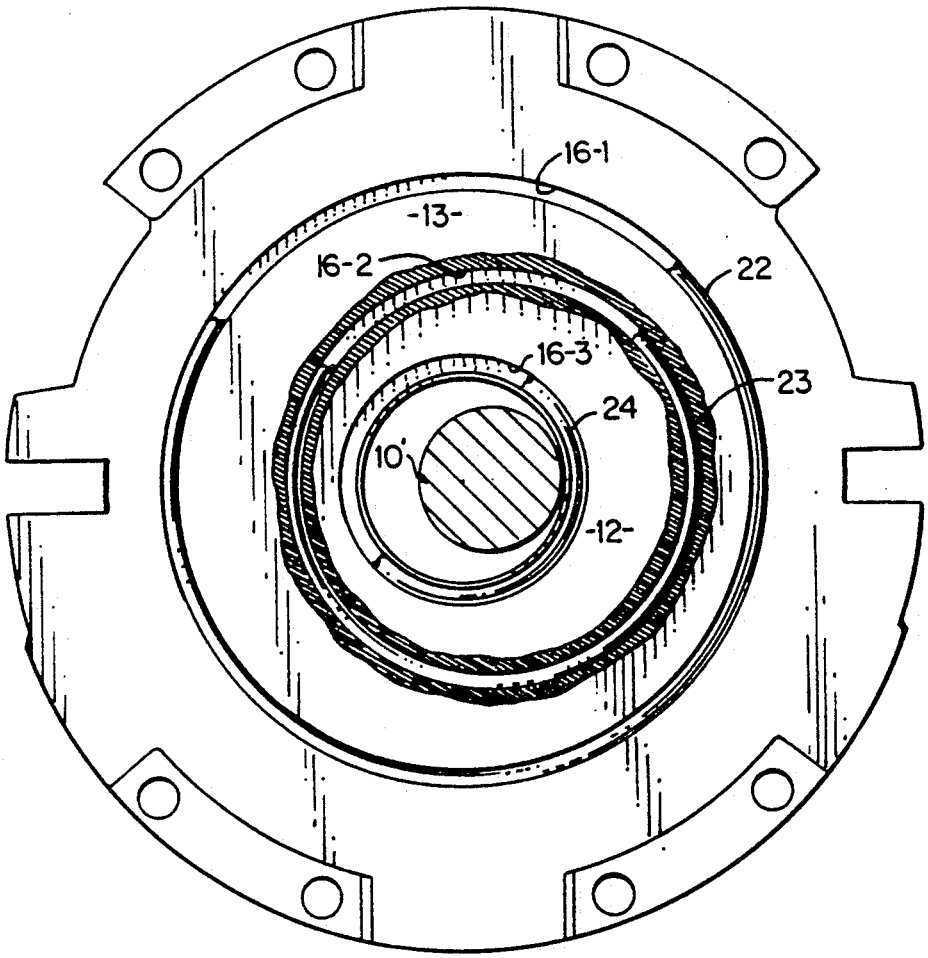
FIG. 5 is a sectional view taken along line 5—5 of FIG. 4.

In FIG. 1, the numeral 10 generally designates the orbiting scroll of a scroll compressor. Orbiting scroll 10 has wrap 10-1 which coacts with wrap 11-1 of fixed 11, an inner axial bore 10-2 and an outer axial bore 10-3. Referring now to FIG. 2, it will be noted that bore 10-2 is in fluid communication with annular pocket or chamber 12 via radial bore 10-4 and axial bore 10-5. Similarly, bore 10-3 is in fluid communication with annular pocket or chamber 13 via radial bore 10-6 and axial bore 10-7. Axial ring 16 coacts with the plate portion 10-11 of orbiting scroll 10 to define radially spaced annular pockets or chambers 12 and 13. Specifically, orbiting scroll 10 has an annular surface 10-8 partially defining chambers 12 and 13. Axial ring 16 coacts with surface 10-8 to partially define chambers 12 and 13. Axial ring 16 is fixed to or integral with crankcase 30 and is of a lesser radial extent than surface 10-8. Axial ring 16 has outer, intermediate and inner circumferential grooves 16-1 to 16-3, respectively formed in face 16-4. Grooves 16-1 to 16-33 receive annular seals 22-24, respectively. Annular seals 22-24 extend from grooves 16-1 to 16-3 and engage the bottom of surface 10-8 to seal and isolate chambers 12 and 13. In operation, as orbiting scroll 10 is driven by the crankshaft (not illustrated) it moves with respect to chambers 12 and 13 such that chambers 12 and 13 change their relative positions with respect to the surface 10-8 of orbiting scroll 10. As wrap 10-1 of orbiting scroll 10 coacts with wrap 11-1 of the fixed scroll 11 to establish and compress trapped volumes of gas, A–E, gas in the trapped volume D which is exposed to bore 10-3 is communicated to chamber 13. Also, gas in the trapped volume A, which is exposed to bore 10-2 and the outlet (not illustrated) in fixed scroll 11, is communicated to chamber 12. Since bore 10-3 is located at an intermediate point in the compression process while bore 10-2 is located in the vicinity of the outlet (not illustrated), chamber 12 is nominally at discharge pressure while chamber 13 is at an intermediate; pressure. It should be noted that in portions of the operating envelope there can be over compression as a result of the operating conditions such that the intermediate pressure is above discharge pressure. Because bore 10-2 communicates with the outlet (not illustrated), pressure in chamber 12 is limited to discharge pressure. Thus, the higher pressure can be in chamber 13 under some circumstances. Also, bore 10-4 could be relocated so as to communicate bores 10-2 and 10-7 and bore 10-6 can similarly be relocated to communicate bores 10-3 and 10-5. This could result in discharge pressure being supplied to chamber 13 and intermediate pressure being supplied to chamber 12. The pressures in chambers 12 and 13 act against orbiting scroll 10 to keep it in engagement with the fixed scroll 11 to 11-1. The pressures in chambers 12 and 13 also act against axial ring 16 and, thereby, crankcase 30. Referring now to FIGS. 4 and 5, orbiting scroll 10' has been modified by locating annular groove 10-9 in surface 10-8 and seal 23 in groove 10-9. Accordingly, groove 16-2 in face 16-4 of ring 16' has been eliminated. Otherwise the device of FIGS. 4 and 5 is structurally identical to that of FIGS. 1–3. However, in operation, this change results in cyclic changes in the shapes of chambers 12 and 13. Specifically, as best shown in FIG. 5, seal 23 is carried by orbiting scroll 10' and moves with respect to seals 22 and 24 such that the radial spacing between seal 23 and seals 22 and 24 changes with respect to any given point. The greater portion of the eccentric pocket 12 which is at discharge pressure is thus maintained opposite to the moment caused by the axial pressure force.

In both embodiments, the location of bore 10-3 is such that it allows the intermediate pressure to exceed the discharge pressure under some operating conditions. Specifically, this permits this device to run at conditions of low pressure ratio without loss of bias force. From the foregoing description, it should be clear that there is an improved axial compliance over the entire operating envelope because of the relatively large radial extent and areas of pockets 12 and 13 and because they are responsive to two pressures in the compression process.

Although preferred embodiments of the present invention have been illustrated and described, other changes will occur to scope of the present invention is to be limited only by the scope of the appended claims.

What is claimed is:

1. In a scroll compressor including a crankcase and a fixed scroll means, axial compliance means comprising:

an orbiting scroll means having a plate with a wrap on a first side and an annular surface on a second side;

annular ring means fixed with respect to said crankcase and coacting with said annular surface to define a plurality of radially spaced annular pocket means;

said pocket means are sealed by inner, intermediate and outer radially spaced seals which are carried by said annular ring means;

fluid pressure supply means for supplying pressurized fluid to said pocket means from at least one trapped volume whereby fluid pressure supplied to said pocket means acts on said orbiting scroll means to keep said orbiting scroll means in axial engagement with said fixed scroll means and spaced from said annular ring means to thereby support said orbiting scroll means in engagement with said fixed scroll means.

2. In a scroll compressor including a crankcase and a fixed scroll means, axial compliance means comprising:

an orbiting scroll means having a plate with a wrap on a first side and an annular surface on a second side;

annular ring means fixed with respect to said crankcase and coacting with said annular surface to define a plurality of radially spaced annular pocket means;

said pocket means are sealed by inner, intermediate and outer radially spaced seals and said inner and outer radially spaced seals are carried by said annular ring means and said intermediate radially spaced seal is carried by said orbiting scroll means; and fluid pressure supply means for supplying pressurized fluid to said pocket means from at least one trapped volume whereby fluid pressure supplied to said pocket means acts on said orbiting scroll means to keep said orbiting scroll means in axial engagement with said fixed scroll means and spaced from said annular ring means to thereby support said orbiting scroll means in engagement with said fixed scroll means.

3. An axial compliance means for a scroll compressor including fixed and orbiting scroll means and crankcase means, said axial compliance means comprising:

said orbiting scroll means having a plate with a wrap on a first side and an annular surface on a second side;

annular ring means fixed with respect to said crankcase means and coacting with said annular surface to define a pair of radially spaced annular pocket means;

said pocket means are sealed by inner, intermediate and outer radially spaced seals and said inner and outer radially spaced seals are carried by said annular ring means and said intermediate radially spaced seal is carried by said orbiting scroll means;

first fluid pressure supply means for supplying fluid pressure to a first one of said pair of annular pocket means;

first fluid pressure supply means for supplying fluid pressure to a second one of said pair of annular pocket means;

whereby fluid pressure supplied to said pair of annular pocket means acts on said orbiting scroll means to keep said orbiting scroll means in axial engagement with said fixed scroll means and thereby supports said orbiting scroll means.

4. An axial compliance means for a scroll compressor including fixed and orbiting scroll means and crankcase means, said axial compliance means comprising:

said orbiting scroll means having a plate with a wrap on a first side and an annular surface on a second side;

annular ring means fixed with respect to said crankcase means and coacting with said annular surface to define a pair of radially spaced annular pocket means;

said pocket means are sealed by inner, intermediate and outer radially spaced seals which are carried by said annular ring means;

first fluid pressure supply means for supplying fluid pressure to a first one of said pair of annular pocket means;

second fluid pressure supply means for supplying fluid pressure to a second one of said pair of annular pocket means;

whereby fluid pressure supplied to said pair of annular pocket means acts on said orbiting scroll means to keep said orbiting scroll means in axial engagement with said fixed scroll means and thereby supports said orbiting scroll means.

5. The axial compliance means of claim 4 wherein said first fluid pressure supply means supplies discharge fluid pressure and said second fluid pressure supply means supplies intermediate fluid pressure.

6. The axial compliance means of claim 5 wherein said first and second fluid pressure supply means are in fluid communication with trapped volumes defined between said fixed and orbiting scroll means.

* * * * *